United States Patent [19]

Clark

[11] Patent Number: 4,587,191

[45] Date of Patent: May 6, 1986

[54] COLLAPSIBLE PHOTORECEPTIVE SHEET INCLUDING A HIGH CONCENTRATION OF VOIDS

[75] Inventor: Harold E. Clark, Hendersonville, N.C.

[73] Assignee: Futures C, Inc., Hendersonville, N.C.

[21] Appl. No.: 568,498

[22] Filed: Jan. 5, 1984

[51] Int. Cl.[4] ..... G03G 13/20

[52] U.S. Cl. ..... 430/97; 430/56

[58] Field of Search ..... 430/31, 56, 67, 66, 430/97

[56] References Cited

U.S. PATENT DOCUMENTS

| | | | |
|---|---|---|---|
| 3,255,039 | 6/1966 | Dalton | 430/56 |
| 3,391,022 | 7/1968 | Saito | 430/56 |
| 3,399,060 | 8/1968 | Clancy | 430/56 |
| 4,258,114 | 3/1981 | Clasen et al. | 430/56 |

*Primary Examiner*—John L. Goodrow

[57] ABSTRACT

A photoreceptive sheet having a surface adapted to carry a reproductive image, the surface of the sheet bearing a photoreceptive layer including a microfoam of a plurality of voids in a mixture of a photoconductive substance and an insulating binder, the photoreceptive layer being capable of receiving an electric charge, responding photoelectrically to light, and discharging photoconductively to form the image.

21 Claims, 8 Drawing Figures

COLLAPSIBLE PHOTORECEPTIVE SHEET INCLUDING A HIGH CONCENTRATION OF VOIDS

BACKGROUND OF THE INVENTION

This invention relates to paper for electrostatic copying machines.

Electrostatic copying machines are of two general types: transfer and non-transfer copiers. Transfer, or, as they are also called, plain paper copiers, employ paper which does not need to be coated with any special materials in order to receive an image. Non-transfer copiers, on the other hand, employ sheets of paper which are coated with a zinc oxide/binder coating which significantly adds to the weight of the sheet and gives the finished sheet a somewhat glossy feel and appearance. Transfer copiers, in order to be able to use plain paper, must include a great deal of complex machinery not necessary in non-transfer copiers.

SUMMARY OF THE INVENTION

I have discovered a way to make a photoreceptor for use in a simple non-transfer copier which produces a finished product essentially as acceptable as the plain paper product of the transfer copier. The invention produces an essentially plain sheet of paper in a copier which does not contain a permanent photoconductor, and does not employ a transfer step, a cleaning step, or any of the auxiliary machinery these require.

The invention features, in general, a photoreceptive sheet having a surface adapted to carry a reproductive image, the surface of the sheet bearing a photoreceptive layer made up of microfoam of a plurality of voids in a mixture of a photoconductive substance and insulating binder, the photoreceptive layer being capable of receiving an electric charge, responding photoelectrically to light, and discharging photoconductively to form an image.

The photoreceptive layer is sufficiently thick to generate, upon receiving the electric charge, an external fringing field capable of attracting sufficient quantities of electrically charged particles to produce the image in the process step called development. After development, the sheet is heated to melt and fix the toner image, but also the microfoam melts, the gas escapes and the layer collapses.

In order to provide the feel and appearance and weight of plain paper, the total collapsed thickness of the solids portion of the microfoam is preferably less than five microns, and the voids to solids volumetric ratio of the photoreceptive layer is preferably at least 3 at 1 and more preferably at least 5 to 1 and most preferably at least 10 to 1.

The voids in the matrix of solids can be enclosed in a polymeric organic compound, e.g. polymethyl methacrylate, or the polymeric compound can be omitted.

The thickness of the photoreceptive layer is preferably less than 30 microns, more preferably less than 15 microns, and most preferably less than 10 microns.

The matrix of solids preferably further includes a sensitizing dye which is in contact with the photoconductive substance, the dye being capable of broadening the spectral response characteristic of that substance; a preferred photoconductive substance is zinc oxide.

In another preferred embodiment the aforesaid matrix of solids has a sub-micron layer coated thereon including a binder very intensely dyed and optionally containing zinc-oxide particles in particle-to-particle contact.

The spectral response characteristics of the photoconductive substance can be broadened by, e.g. heating to produce a color change, as an alternative to employing a sensitizing dye.

When a sensitizing dye is employed, the weight ratio of the dye to the photoconductive substance is preferably a first ratio which is greater than a second ratio defined by the lowest dye-to-photoconductive substance ratio which would cause a visually noticeable non-white color in a 25-micron thick solid layer on a white paper sheet, the first ratio not being so great as to cause a visually noticeable non-white color on a white sheet. Preferably, then, the ratio of the first ratio to the second ratio is no greater than the ratio of 25 microns to the collapsed thickness of the photoreceptive layer.

Preferably as much as possible of the photoreceptive microfoam layer is voids rather than solids; this is achieved in microfoam in which at least some voids are separated from adjacent voids by a one particle thick layer of the photoconductive substance.

The size of the voids and photoconductive particles can vary. The voids preferably have an average diameter between 2 and 7 microns, while the photoconductive substance within the binder-photoconductor mixture is preferably in the form of approximately equi-axed particles of average diameter of 0.1 to 0.5 microns.

DESCRIPTION OF PREFERRED EMBODIMENTS

We turn now to a description of preferred embodiments of the invention, after first briefly describing the drawings.

DRAWINGS

STRUCTURE AND COMPOSITION

Figure 1:
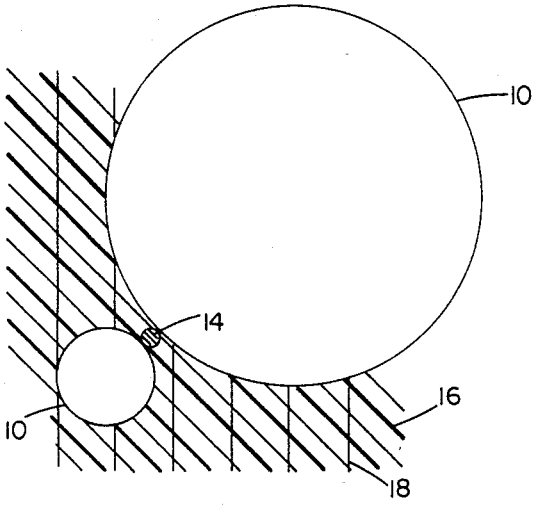
FIG. 1 is a diagrammatic representation of two adjacent microvoids of the invention.

Referring to FIG. 1, each microvoid 10 is two to seven microns in diameter, the average diameter of each void being about four microns; there is preferably some variability in the diameter of the microvoids so that interstitial space is minimized by random close packing.

Each microvoid 10 is surrounded by contiguous zinc oxide particles 14; each zinc-oxide particle is approximately equi-axed and of a diameter of about 0.1 to 0.3 microns.

The zinc oxide particles are distributed throughout conventional insulating binder 16, at a density at which zinc oxide particles are contiguous. Zinc oxide and binder are in a volumetric ratio of 1:1. Also distributed throughout the binder is an effective amount of dye 18, which is a conventional dye, including but not confined to those used to sensitize silver halides, e.g., rose bengal or fluorescein, which broadens the spectral response characteristics of the zinc oxide. Microvoids 10 are separated by one zinc oxide particle.

Figure 2:
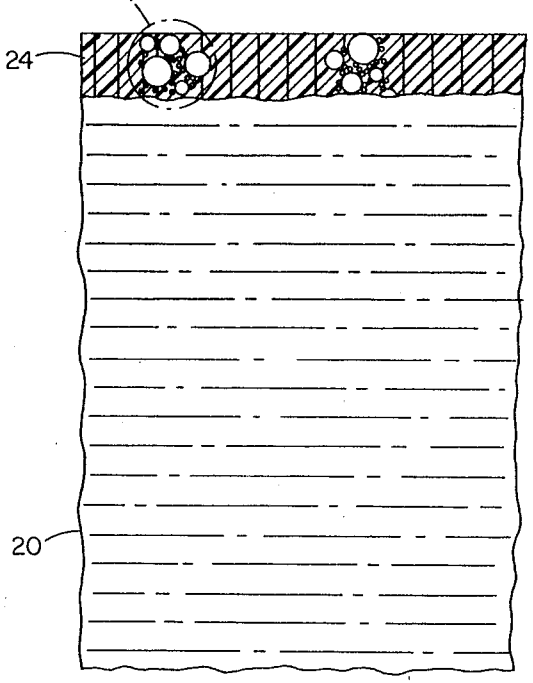
FIGS. 2 and 2A is a diagrammatic cross-section of a photoreceptive sheet of the invention.
Figure 2A:
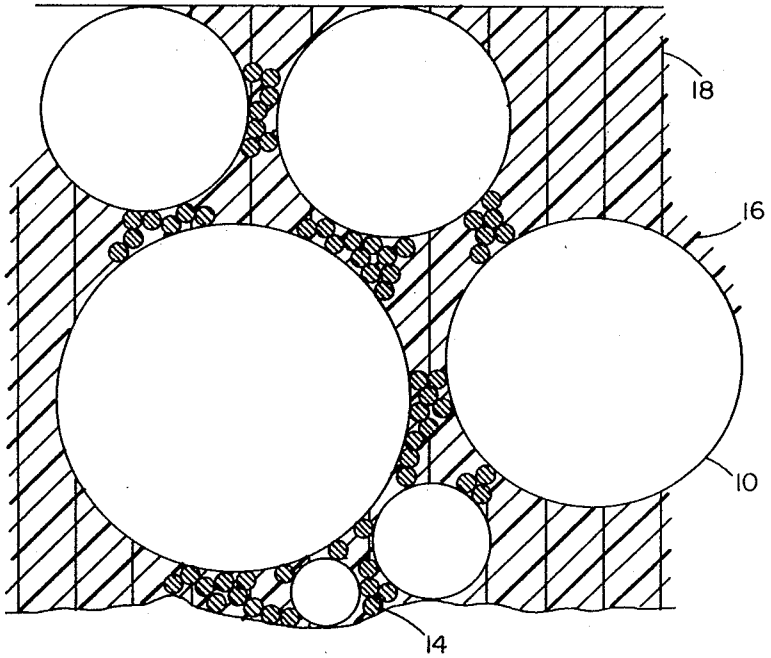

Referring to FIG. 2, sheet 20 is a conventional piece of white paper, about 100 microns thick, of composition and weight commonly used in transfer copiers. Sheet 20 has a surface roughness corresponding to troughs about 4 microns deep.

Sheet 20 bears a photoreceptive microfoam layer 24 composed of microvoids as shown in FIG. 1. Layer 24 is approximately 10 microns thick.

Figure 3:
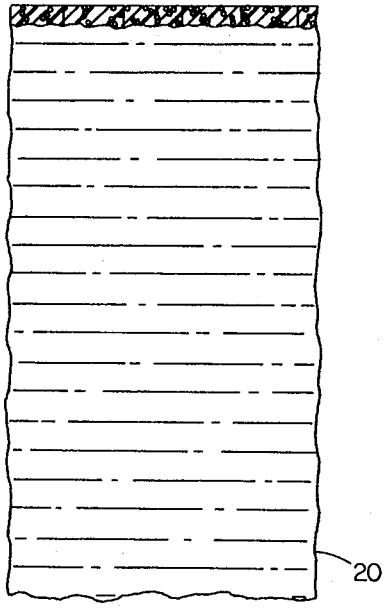
FIG. 3 is a diagrammatic cross-section of said sheet in collapsed condition.

FIG. 3 shows the sheet of FIG. 2 in collapsed state, i.e., after the voids have collapsed leaving only zinc oxide, binder, and dye (as well as the image, not shown). The collapsed total solids layer is about 2 microns thick.

Figure 4:
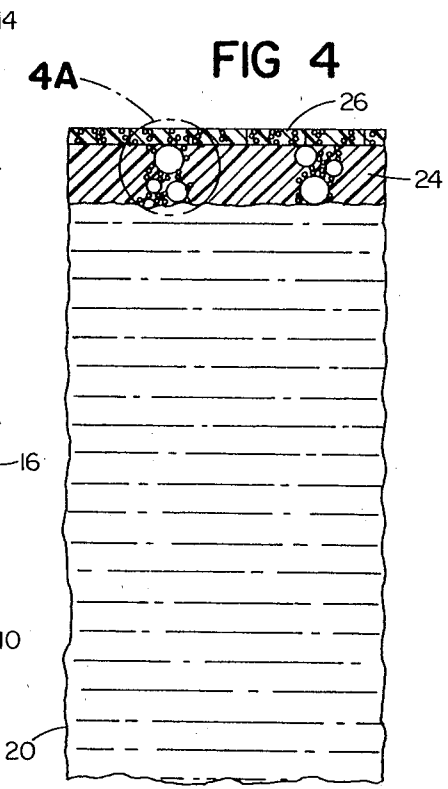
FIGS. 4 and 4A is a diagrammatic cross-section of a photoreceptive sheet bearing a concentrated dye top layer containing zinc oxide.
Figure 4A:
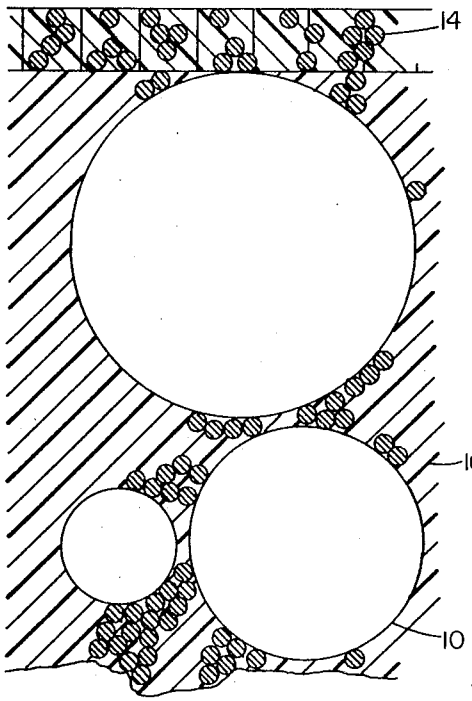

FIG. 4 illustrates a sheet coated as shown in FIG. 2, except that layer 24 does not contain dye, and that it contains a top layer 26 of zinc oxide particles and binder, intensely dyed with the same dye; layer 26 is several zinc oxide particles thick.

Figure 5:
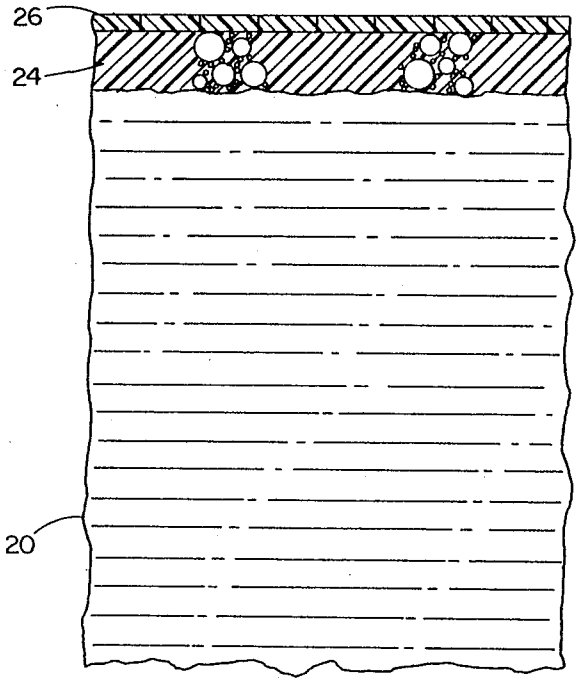
FIG. 5 is a diagrammatic cross-section of a photoreceptive sheet bearing a concentrated dye top layer without zinc oxide.

FIG. 5 illustrates a sheet coated as shown in FIG. 4 except that the top layer 26 does not contain zinc oxide.

Figure 6:
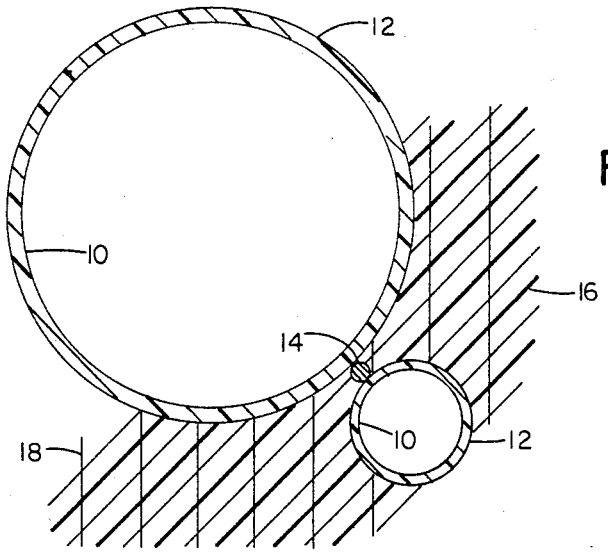
FIG. 6 is a diagrammatic representation of two adjacent microspheres of the invention.

FIG. 6 illustrates a void of a microfoam layer like that of FIG. 1, except that each void is enclosed in a microshpere 12 of e.g. polymethyl methacrylate.

MANUFACTURING PROCESSES FOR MICROFOAM-COATED PAPER

I shall describe several different processes for manufacturing a sheet bearing a microfoam layer. In the first two processes, the binder mixture is foamed to generate gas voids in the photoconductive-binder mixture. In another process, the gas voids are first manufactured as thin-walled microspheres in a separate step.

Speaking generally of the foaming of plastics, it is a well-known and widely practiced art and has led to the creation of major industries. Blowing agents of gas or solids which decompose into gases are widely used for these purposes.

We employ such technology but with some variations. We begin with a mixture of dissolved binder plus zinc oxide, or these components plus dye.

The process we shall describe could be called precision boiling to create bubbles. We shall begin with a solvent of one molecular species, such as a hydrocarbon or alcohol, with a single boiling point, and dissolve the binder in it and add zinc oxide and dye. If this is heated to just below the boiling point, then we shall pass the mixture through, say, a horizontal heated screen which adds just enough energy so that boiling takes place under conditions which create tiny bubbles, which escape upwards. If the mixture had been barely soluble, the bubbles may be slightly sticky, either from residual solvent or from heat-softened binder. The bubbles will then cluster but will be immersed in too viscous a medium to merge into larger bubbles. This is exactly what is desired.

Such a foam of bubbles rises to the top of the mixture. The web of paper to be coated is brought from above into continuously moving contact with the foam as it is created. This process can be called skim coating. Some drying will be necessary. Once a good choice of parameters has been made, the process would appear to be reliable and inexpensive.

The procedure just described for precision boiling can be rendered even more precise if one could predetermine the size of each bubble. A way to do this would be to introduce into the binder a slurry of fine particles, each of which, later on, produces one bubble of the desired size. This is, each particle is to decompose into one bubble several microns in size. At normal temperatures and pressures, a gas has perhaps one to several thousand times the volume of the liquid or solid from which it forms; this means that in one dimension the solid would be one-tenth or less of the dimension of the gas. Hence to form a bubble of, say, 3 microns the solid particle should be one to three tenths of a micron in size.

The original foamed polymer, sponge rubber, was produced over 50 years ago by incorporating in the polymer sodium bicarbonate which upon heating decomposes into carbon dioxide as the foaming agent. We can do the same with the melted or dissolved binder-photoconductor mixture to generate a microfoam by beginning with sodium bicarbonate particles of submicron size.

This binder melt would be forced upward into a space in which the temperature would be increased to the decomposition temperature. Each individual particle of sodium bicarbonate would decompose to form a bubble of the desired size. This would in turn form a dense assembly of bubbles within a thin-walled matrix of the binder and zinc oxide; this foam would then be skim-coated on a moving paper substrate and cooled to produce the final desired product. Other decomposible materials can be considered, such as Azobisisobutyronitrile which produces nitrogen when heated.

A second approach to microfoam creation is to generate gas bubbles within a dissolved or melted binder-photoconductor mixture and to collect such bubbles into a microfoam which is skim coated onto a moving paper substrate as already described above. Such bubbles can be introduced under pressure through micron-sized holes in a screen suspended in the binder mixture. Pressurized gas will naturally form small spheres as the emitted stream necks off in lengths about three times the hole diameter, but the process can be stimulated to assume this pattern by vibrating the screen or pulsing the gas pressure in synchronism with the streaming rate.

Thermoplastic binders suitable for solution coating are listed in U.S. Pat. No. 2,959,481, issued to Thomas J. Kucera. They include vinyl acetate homopolymers, vinyl acetate vinyl copolymers and numerous others.

An alternative to bubble formation is to use preformed microspheres as the source of the voids in the matrix. A method of making suitable microspheres is described in Kanega et al U.S. Pat. No. 3,293,114, hereby incorporated by reference. The enclosing polymer therein described is polymethyl methacrylate.

The microspheres are added to a dissolved mixture of binder, zinc-oxide powder and optional sensitizing dye to form a slurry and then are coated by conventional methods onto the paper substrate and dried. The concentration of constituents in the coating is chosen so that the dried microfoam consists of microspheres, at least some of which are separated at their nearest point by a thickness of the dried mixture corresponding to the size of a zinc-oxide particle.

The microfoam containing pre-formed microspheres, introduce an interface between the shell enclosing each microsphere and the photoconductorbinder. Such an interface could contain sites for trapping the migrating electrons, and thus could reduce net discharge caused by light. Because such an interface is avoided if the binder-photoconductor mixture alone comprises the microfoam, such a system is preferred over the preformed microsphere system.

For any of the coating methods, it would be useful to illuminate the coating step, so that deposition would be performed in an electrically conductive state, thus eliminating that random electrostatic charge which could interfere with smooth and reliable coating.

For the embodiments in which the microfoam bears on its surface a second thin, intensely dyed layer, such second layer is coated by conventional methods after the addition of the microfoam layer, which in this two-layer case does not contain dye. The dyed top surface layer is composed of a very thin (approximately 0.1 to 1.0 micron) layer of binder containing a dye or zinc oxide and binder which contains a sensitizing dye, as described above, or in which the zinc oxide particles have been colored by heat treatment, e.g. as described in Young et al (*RCA Review,* 15 469 (1954)).

OPERATION

In operation, the microfoam-coated sheet is used in what is recognized by those skilled in the art as a nontransfer electrostatic copier. In such a machine, a photoreceptive sheet of the invention is fed past a corona charging unit which emits negative ions near the surface of the grounded photoreceptive sheet, and deposits a uniform negative charge onto its surface. This creates upon that surface a strong electrostatic field which in the photoreceptive dielectric material of the sheet amounts to, say, 12 volts per micron.

The sheet is then exposed to a light image of an existing hard copy, or to an equivalent electronically created optical image, in wave lengths to which the photoreceptive layer is sensitive.

As a result of exposure in the bright areas of the original, electron-hole pairs are created in the top layer of the microfoam and, through secondary processes which are only partially understood, the net negative electronic charge migrates through the chain of zinc-oxide particles toward the grounded paper substrate. To the extent that a photon-generated electron results in the delivery to the base of one electronic charge, the quantum efficiency of the process is one. Various secondary processes can interfere with the details of such particle migration. For example, a charge can "fall" into any one of numerous electrical potential traps of various depths, from which it can emerge at a rate depending on trap depth. Thus the effective quantum efficiency of the process is a function of trap density and depth, and also of time available between exposure, which forms the latent image, and the beginning of development. It is an option in machine design to decide when to start development after exposure; a delay of several seconds between exposure and development may enhance trap emptying discharge and hence electrostatic contrast.

Following development to form a visually pigmented particle image, particles are fixed to the surface of the microfoam-coated paper. Fixing is achieved by heating the surface to soften and affix a pigmented resin toner image. This heating also serves to soften the microvoids so that the gas in the voids can escape and the microfoam structure can collapse.

It is most desirable to apply the fixing and microvoid collapsing heat to the sheet at a high power level, so that the temperature of the microspheres is raised quickly. The viscosity of the solid material in the microfoam must be reduced to permit the spheres to collapse as the gas escapes. Delivery of energy over a long period of time would undesirably permit heat to dissipate before the spheres could soften and collapse. This suggests, as an engineering choice of fixing elements, the use of an intensely focused moving line of radiation.

Once the image has been fixed and the microfoam has collapsed, the paper-bearing image, has the feel, not of a coated sheet, but of an essentially plain sheet of paper used in a transfer copier.

As mentioned above, one of the advantages of using the photoreceptor sheets of the invention is that they can be used with simple nontransfer copiers. This advantage can be appreciated by comparing the components of such copiers to those of the much more complicated transfer copiers which use plain paper.

Transfer copiers must contain a well mounted semipermanent photoreceptor, with precisely operating motors and bearings, and means for removing and replacing the photoreceptor. A transfer copier must also provide a mechanism for driving the plain sheet of transfer paper in synchronous contact with the semipermanent photoreceptor after the charging and development steps. This step must be accompanied by the activation of a separate corona transfer device to pick the paper and the toner image off the photoreceptor. A mechanism also is needed to lift the transfer paper from the photoreceptor to which it becomes firmly adhered by electrostatic forces. The photoreceptor surface must be cleaned of residual toner, and the toner collected and disposed of. All of the equipment needed to accomplish these steps is absent in a nontransfer copier which employs the photoreceptor sheet of the invention.

A further advantage of nontransfer copiers is that the semipermanent photoreceptor of transfer copiers behaves differently throughout its lifetime because of various influences, e.g. corona charging, mechanical abrasion during development and cleaning, internal changes arising from light exposure, and interrelated effects, all of which must be compensated for by the addition of control mechanisms in order to maintain stable performance. None of this is necessary in nontransfer copying, since each sheet of photoreceptive paper is virgin and identical in performance properties.

FUNCTIONAL ANALYSIS

As mentioned above, an important advantage of the invention is that the image-bearing sheet, as received by the user, does not appear to coated, since the volume of solids has shrunk to a very thin, virtually imperceptible layer. In addition the invention has other advantages which flow from its unique structure. One of these is the enhanced developability brought about by the use of gas of low dielectric constant, rather than solid material, to provide thickness. The other major advantage is the ability to greatly concentrate sensitizing dye in the very small amount of photoconductor/binder material present in the microfoam. Before discussing these advantages further, the photoconductive performance of the microfoam will be analyzed.

Let us begin by using as a benchmark a commercial zinc-oxide binder coating on paper which is typically 1 mil (25 microns) thick and which operates typically at 300 volts charging potential, or 12 volts/micron. Let us duplicate this performance with a microfoam coating of the same thickness. While a selected mixture of sizes would result in an optimized set of interstitial voids, let us ignore such detail and consider a foam coating made up of 3-micron voids and zinc-oxide particles 0.3 microns in diameter. We will picture about seven layers of voids (21 microns) and eight layers of zinc oxide and binder, or about 2.5 microns.

In the analysis below, we shall start by considering only the electrostatic aspects, and ignore the photoconductivity. Of course the binder mixture must and does start at the top and thread its way conductively to the base, but here we shall assume that the entire structure can be regarded as a series of capacitative sheets alternately made of gas and photoconductor binder. Also, these alternating layers are capacitatively equivalent to one summed layer of gas and a summed layer of photoconductor binder. We start by imposing the condition that charging will be provided as necessary to achieve the charge density required normally for electrostatic performance. Without any detailed analysis, it follows that the photoconductor is therefore present under normal field conditions, and will generate and transport charge as usual (because of its inter-connectedness to the base). With eight photoconductor-binder layers, each 0.3 microns thick for a total thickness of about 2.5 microns, and charged to a level of 12 volts/micron, this must sustain 30 volts. The dielectric constant of this solid material is about 3, while gas has a dielectric constant of only 1 (one) so that its capacitance per unit thickness is three times that of the binder, and its internal field is 36 volts/micron. With seven layers of three-micron voids and a total thickness of 21 microns, the total gas thickness sustains a potential difference of $36\times21$, or 756 volts. The surface potential is thus $30+756$, or 786 volts, for the example cited, using the idealized capacitance model of the coating 23.5 microns thick. It is of major significance to conclude by this analysis that in every electrostatic respect, this coating will work normally, assuming interconnectedness within the microfoam.

The field cited above within the voids is 36 volts/micron. It is usually reported that free air in larger volumes is able to sustain about 1.2 volts/micron before sparking. However, such breakdown occurs because of the presence of ions from natural radioactivity or cosmic rays or by contact with electrodes. There are no electrodes in the case, and the extremely small volumes, each one isolated, are statistically unlikely to contain the casual ions present in open large air volumes. Therefore sparking will not occur, the fields calculated are sustainable, and the overall conditions for operation constitute a valid practical working photoreceptor system.

The aforesaid structure should be designed to be filled with microvoids to the maximum possible extent, in order to utilize the least amount of zinc oxide and binder mixture. Optimum random packing requires a distribution of void sizes, to minimize interstitial space. The mixture material should contain a sufficient percentage of zinc-oxide particles to produce point contact between the adjacent particles. To the extent that this principle holds, it suggests that the zinc-oxide particle size defines the minimum and hence desirable thickness of the web of microfoam. Presumably particle contact enables charge released at the exposed particle to be transported by the particle chain through the microfoam to the base layer, while the insulating property of the mixture is maintained by its binder constituent. The physics of internal charge transfer is complex and not well understood. However, the present invention simply depends on the empirical knowledge of particle-binder behavior as it is used today. The structural novelty of the microfoam does not change the internal behavior.

The model made up of layers of alternating gas and photoconductor-binder is incomplete even with respect to electrostatics alone. The vertical conductive paths of photoconductor-binder constitute a significant volume and modify both the capacitance and the voltage values just cited. If we think of the top layer of photoconductor-binder film (say, 0.3 microns thick), followed by a layer of voids (say, 3 microns in diameter), the film continues downward around each void for a distance of 3 microns. Hence in the void-surrounding region, the binder layer is not 0.3 microns thick, but 3.3 microns. This affects the corona charging and the surface potential by increasing the amount of higher dielectric constant material present. For the next layer of randomly located voids and the next, down to the base, such vertical pathways will continue, and we should recognize the presence of this volume of binder material and estimate its quantity and its consequence. If we approximate the voids as 3 micron cubes, each cube has verticle sides coated with binder layers 3 microns high and 0.3 microns for each of 4 sides. Each side is shared with a neighbor cube, so that we shall say that one-half of this binder volume, namely $\frac{1}{2}(3\times0.3\times4)$, or 6.6 square microns, is identified with one cube. We shall call this the "vertical" binder layer. The "horizontal" binder layer coating associated with an internal cube is shared half above and half below with two cubes and has an area (3.3)2 or 10 square microns. These rough calculations therefore suggest that the volume of vertical binder is two-thirds of that of the horizontal binder (i.e., 6.6/10). Conservatively we shall assume that the vertical binder is equal to the horizontal binder and we must double our previous estimate.

Hence we revise upward our estimate to a thickness of interstitial material to 5 microns instead of 2.5 microns. This volume requires a charging potential not of 30 volts, but of 60 volts. The volume of gas spheres remains unchanged and the potential difference required for them remains at 756 volts. Hence the surface potential is now $60+756$, or 816 volts. Obviously the real situation with moderately packed voids of various sizes would be very complicated to describe, but we have arrived at a reasonable estimate of how much interstitial material there will be. This present rough treatment suggests that we can expect a residual of 5 microns of material after fixing. This is thin enough to be imperceptible on the naturally rough surface of paper.

Nevertheless it is obviously desirable to reduce the volume of interstitial material even more. If the zinc-oxide particles were 0.1 micron in size instead of 0.3 micron, as can be the case, the volume would be reduced linearly by $\frac{1}{3}$, and the collapsed layer would be, not 5 microns, but (5/3) microns. Since the photoelectric effect in zinc oxide is a surface effect, the smaller particles can be just as effective. A final layer (5/3) micron thick layer should certainly be imperceptible.

ENHANCED DEVELOPABILITY

We turn now to a more detailed discussion of the enhanced developability of the photoreceptive sheet of the invention.

Whereas a conventional zinc oxide coating is charged to 300 volts, the microfoam coating discussed above charges to 786 volts, and, in fact, would charge to about (25/23.5) times that, or nearer 830 volts if we had conceptualized a full 25-micron layer (to match the aforesaid benchmark thickness) instead of 23.5 microns.

This higher potential has major consequences in electrostatic toner development. A larger initial potential, in this case 830 volts instead of 300 volts, produces a larger fringing field and produces higher developability.

The surface potential of 830 volts rather than 300 volts is almost three times that of the benchmark conventional sheet and is almost comparable to that used for 80-micron selenium-metal photoconductors as employed in the very best transfer copiers. Hence one-to-one substitution of an equal thickness of microfoam photoreceptor for solid photoreceptor brings with it a very large improvement in copy quality.

One can now recognize the opportunity to take advantage of this enhanced capability in the microfoam coating concept in different ways. For example, rather than achieve the above higher image quality, one can instead choose simply to match the performance of the 25-micron 300-volt conventional coating by reducing the microfoam coating thickness to, say, (300/830) or 36 percent of 25 microns, to make a coating only 9 microns thick charged to 300 volts. The developability characteristics of this very thin coating would match that of the benchmark conventional coating. Additionally this extremely thin microfoam coating will collapse to essentially zero thickness after heat fixing.

ENHANCEMENT OF DYE EFFECTIVENESS

The maximum amount of dye which can be used on a coated sheet without perceptibly affecting the visual color of the sheet is a function of the weight of dye per unit area. The same weight of dye used in the benchmark sheet can be used in the reduced solids of the microfoam structure, with the result that the concentration of the dye is increased by the ratio of the weight of the solid layer of the benchmark sheet to the weight of the microfoam of the photoreceptor sheet of the invention, say five to one. Hence, the dye effectiveness in the sheet of the invention is five times that of the benchmark layer, for coatings of equal thickness. And if we trade off some enhanced developability for thinness by reducing the thickness of the microfoam, say to a thickness which only equals the benchmark layer in developability, we have even less total weight of microfoam to which we can add the same total dye weight, to provide an even greater dye concentration and hence sensitization.

Starting with the previous example of the five-fold increase in dye sensitization by replacing the conventional 25-micron coated sheet with the 5 microns of microfoam, we combine this with the (25/9) decrease in microfoam thickness created by the developability gain, about 2½ times reduction in material, for a sensitization gain of about twelve times. This is all available without any loss in performance, along with the enormous gain in sensitivity and with the production of a final fixed and finished sheet with essentially zero coating on it.

THE TWO-LAYER CONCEPT

As mentioned above, one embodiment of the invention employs on the upper surface of the microfoam a thin intensely dyed zinc oxide coating. We now discuss the functioning of that embodiment.

The response of an electrostatically charged electrostatic photoconductor to light can be regarded as consisting of at least two independent mechanisms. The first mechanism is the release of charge, in this case electrons, by incident light at or near the free surface. The second mechanism is the transport of such charge through the photoreceptor in the direction of the substrate caused by the imposed electric field. Not only can these mechanisms be separated, at least in part, but the functions can be served by separate layers specifically designed for this purpose, as described below.

We shall call the microfoam layer the charge transport layer. On top of this layer is the layer we shall call the photoactive layer, one example of which is a very thin layer of zinc oxide and binder which is sensitized to longer wavelengths by dyeing or heating. One such dye could be Bromphenol Blue (ref. W. Eckenbach, "Dielectric Properties and Quantum Efficiency of Zinc-Binder Layers", in *Current Problems in Electrophotography,* DeGruyter Berlin and New York, (1972)).

In thickness, the photoactive layer can be as thin as the diameter of one zinc-oxide particle, down to say 0.1 micron or it can be as thick as several zinc-oxide particles, or say 1.0 microns thick. This very thin layer contributes essentially zero thickness to the coating. The total weight of dye or equivalent sensitizing agent in this aforesaid very thin layer can be as much as is added to the entire thickness of the benchmark sheet. Thus the very thin layer will be intensely dyed for its thickness but will add no more color than is found in a conventional paper sheet. Thus we have constructed a two-layer photoreceptive sheet, whose bulk thickness consists of the microfoam layer, which is the charge transport layer, and whose primary photoactive layer is the overlying heavily dyed but very thin layer of zinc oxide and binder.

Alternatively the very thin photoactive layers coated on top of the microfoam layer need not contain zinc oxide. For example, it can consist simply of a dye-containing layer which photogenerates electrons, such as the complex of polyvinyl carbazole and trinitrofluoronone (ref. R. M. Schaffert, IBM Journal of Research and Development, 15, 75 (1971)).

Functionally, the two-layer structure, when electrostatically charged for use and then exposed to broad-spectrum light, will release electrons internally near the free surface, and this release will be especially confined to the very thin photoactive layer because of the high concentration of dye or its equivalent. The major result of such electron release is that such electrons, either directly or through secondary processes, will transport the charge down to and through the bulk microfoam layer toward the substrate, thus causing the discharge which constitutes electrostatic image formation.

A further electronic process occurs which adversely affects such discharge. The electrons can be trapped at various internal sites, which are identified in part with the dye and also with the particles of zinc oxide. For present purposes we shall discuss only trapping associated with the dye.

If these electronic charges so trapped are not released before the electrostatic image is developed with toner, the full discharge initiated by exposure does not take place and to the extent such trapping interferes with the process the developed image will have been weakened. The electrostatic contrast will thus be lessened by the trapping process.

The presence of dye increases trapping. One can compare two cases in which in the first case the normal weight of dye for a conventional sheet is present throughout the microfoam web in a single layer of microfoam photoreceptor layer. In the second case the two-layer coating, the same amount of dye is present in the top very thin layer.

In both cases, the additional spectrum-enhanced photogeneration of the added dye is the same. Also, the degenerative trapping effect caused by the dye is the same; in both cases these are processes which respond to the total amount of dye present, irrespective of the dye location in depth. If we consider the two-layer case, one can picture both processes taking place almost simultaneously, so to speak, with photogeneration closely followed by trapping in the very thin layer, and thus the net surviving photoelectrons emerge into the electron transport layer for relatively low trapping (by zinc oxide only) and migration to the base. Hence the surviving photoelectrons are transported more or less fully toward the substrate and produce an electrostatic image of good contrast.

In comparison, if we think of the one-layer dyed microfoam case, the same net non-dye trapped photoelectrons as a class emerge only totally at the substrate. Since some photoelectrons originate at the top and survive, on the average, net photoelectrons emerge for transport at the half-thickness of the microfoam layer, so that the weakening of the electrostatic image by dye trapping in the case constitutes twice the adverse behavior as compared to the two-layer case.

This is a very simplified analysis, which among other things ignores other trapping mechanisms. Nevertheless, it establishes the advantage of two-layer coating over one-layer coating particularly in producing a greater electrostatic image contrast.

OTHER EMBODIMENTS

Other embodiments are within the following claims. For example, the photoreceptive sheet of the invention can be used in environments other than office copiers. One application is the use of the photoreceptor sheet in computer printing.

A common present-day system for creating characters is the electrical system of a computer in which a set of signals for generating characters is stored, most commonly in raster form. Such characters could be imaged on the photoreceptive sheet of the invention, using appropriate optics in an appropriately designed machine for producing a visible final image on the paper sheet in a computer generated print. To achieve this, one would sensitize the photoreceptive sheet to correspond spectrally to the wavelength emitted by the character generator of the computer. If, for example, the generator is a solid-state diode laser which emits near-infrared light, the sensitizing dye must match this emission in its sensitivity. An alternative to the laser could be the use of a cathode-ray tube to generate the image.

A variety of photoconductive substances could be used to make the microfoam. One possible material is anthracene. Historicaly anthracene was the first imaging material used by the inventor of electrostatic electrophotography, Chester Carlson. It has never been commercially pursued because of its slow photographic speed. The concept of a microfoam photoreceptor, however, can reopen a consideration of its potential. Because of its very low photographic response, it might first be examined, say, as a charge transport medium in which the anthracene is present as the thick microfoam layer (i.e. several microns thick) over which has been coated a sub-micron thickness of photoactive dye in a binder.

Somewhat more speculative is the possibility that anthracene itself could be dyed intensely enough in the fabrication of a single-layer microfoam so that practical through-the-lens optical copying could be accomplished. Nevertheless for either the first mentioned two-layer case or the single-layer case of a microfoam made of anthracene (with or without a binder), the toner copy so made and heat fixed in the final processing step would contain no particulate material in the thin collapsed layer and would be even less perceptible to the user than one containing zinc oxide.

What is claimed is:

1. A method of producing an image on a photoreceptive sheet so that said sheet, bearing said image, has the feel essentially of a plain piece of paper, said method comprising exposing the photoreceptive sheet bearing a photoreceptive layer comprising a microfoam comprising a plurality of voids in a mixture of a photoconductive substance comprising a solids component, and an insulating binder said sheet being further characterized in that the voids to solids volumetric ratio of said photoreceptive layer is at least five to one, to an image to form a latent image, developing said sheet bearing said latent image to form a visual image, and treating said sheet to cause the collapse of said voids.

2. The method of claim 1 wherein said photoreceptive layer is sufficiently thick to generate, upon receiving said electric charge, an external fringing field capable of attracting sufficient quantities of electrically charged particles to produce said image.

3. The method of claim 1 wherein the total collapsed thickness of said mixture is less than five microns.

4. The method of claim 1 wherein said ratio is at least ten to one.

5. The method of claim 1 wherein said matrix of solids further comprises a polymeric organic compound enclosing said voids.

6. The method of claim 1 wherein said photoreceptive layer is less than thirty microns thick.

7. The method of claim 6 wherein said photoreceptive layer is less than fifteen microns thick.

8. The method of claim 7 wherein said photoreceptive layer is less than ten microns thick.

9. The method of claim 1 wherein said mixture further comprises a sensitizing dye in contact with said photoconductive substance, said dye being capable of broadening the spectral response characteristics of said photoconductive substance.

10. The method of claim 1 wherein said photoconductive substance comprises zinc oxide.

11. The method of claim 3 wherein said collapsed thickness is less than two microns.

12. The method of claim 1 wherein said photoconductive substance is treated to broaden its spectral response characteristics.

13. The method of claim 12 wherein said treatment comprises heating to produce a color change in said photoconductive substance.

14. The method of claim 9 wherein the weight ratio of said dye to said photoconductive substance is a first ratio which is greater than a second ratio defined as the lowest dye to photoconductive substance ratio which would cause a visually noticeable non-white color in a 25 micron thick solid layer on a white paper sheet, said first ratio not causing such a visually noticeable non-white color on said sheet.

15. The method of claim 14 wherein the ratio of said first ratio to said second ratio is no greater than the ratio of 25 microns to the collapsed thickness of said photoreceptive layer.

16. The method of claim 1 wherein at least some said voids are separated from adjacent voids by a one-particle thick layer of said photoconductive substance.

17. The method of claim 1 wherein said voids are microspheres of average diameter between two and seven microns.

18. The method of claim 1 wherein said photoconductive substance is in the form of approximately equiaxed particles of average diameter of 0.1 to 0.5 microns.

19. The method of claim 1 wherein overlying said microfoam is a sub-micron layer comprising a photoactive dye capable of releasing charge to the underlying matrix.

20. The method of claim 19 wherein said sub-micron layer further comprises a photoconductive substance different from said dye.

21. The method of claim 19 wherein said sub-micron layer further comprises an insulating binder.

* * * * *